US005203146A

United States Patent [19]

Gambetti

[11] Patent Number: 5,203,146

[45] Date of Patent: Apr. 20, 1993

[54] MACHINE FOR THE PACKAGING OF ARTICLES OF ANY SIZE IN SHEETS OF, IN PARTICULAR, A HEAT-SHRINKING MATERIAL

[75] Inventor: Mario Gambetti, Crevalcore, Italy

[73] Assignee: Baumer S.r.l., Modena, Italy

[21] Appl. No.: 835,135

[22] Filed: Feb. 12, 1992

[30] Foreign Application Priority Data

Jul. 29, 1991 [IT] Italy ..... 000287 A/91

[51] Int. Cl.[5] ..... B65B 11/10; B65B 49/10; B65B 53/02

[52] U.S. Cl. ..... 53/557; 53/588; 53/210

[58] Field of Search ..... 53/210, 209, 389.5, 53/557, 588, 589, 590

[56] References Cited

U.S. PATENT DOCUMENTS

| | | | |
|---|---|---|---|
| 2,424,406 | 7/1947 | Marshall et al. . | |
| 2,953,880 | 9/1960 | Sramek et al. . | |
| 3,331,312 | 7/1967 | Leslie et al. | 53/589 X |
| 3,540,187 | 11/1970 | Monaghan | 53/210 X |
| 3,791,100 | 2/1974 | Monaghan . | |
| 3,869,844 | 3/1975 | Edouard . | |
| 3,927,507 | 12/1975 | Reid . | |
| 3,995,791 | 12/1976 | Schoppee . | |
| 4,178,739 | 12/1979 | DuBroff | 53/210 X |
| 4,333,301 | 6/1982 | Koutonen et al. | 53/589 X |
| 4,499,709 | 2/1985 | Miyano et al. | 53/210 X |
| 4,574,565 | 3/1986 | Gambetti . | |
| 4,706,444 | 11/1987 | Gambetti . | |
| 4,875,329 | 10/1989 | Miselli . | |

FOREIGN PATENT DOCUMENTS

| | | |
|---|---|---|
| 958377 | 5/1964 | United Kingdom . |
| 1037261 | 7/1966 | United Kingdom . |
| 1296306 | 11/1972 | United Kingdom . |
| 1355571 | 6/1974 | United Kingdom . |
| 1382842 | 2/1975 | United Kingdom . |

*Primary Examiner*—John Sipos
*Assistant Examiner*—Linda B. Johnson
*Attorney, Agent, or Firm*—Herbert Dubno

[57] ABSTRACT

A machine for packaging articles of any size with sheets of material comprising a wrapping conveyor, conveyor for delivering and receiving articles to and from the wrapping conveyor and endless wrapping conveyor with a bar moving along a track which passes around the wrapping conveyor in which the wrapping conveyor and the conveyor for receiving the articles have structured conveying surfaces with ends which can be positioned adjacently but at a distance and adjusted in a complementary movable way in two directions and the conveyor and wrapping conveyor with a bar is supported by a supporting structure which is in turn rotatably supported so that it can be adjustably positioned about a horizontal axis.

7 Claims, 4 Drawing Sheets 1
2
3
4
5
6
7
9
10
11
11a
11b
12
13
15
15a
15b
16
17b
18a
18b
19
20
21
22a
22b
23
24
25
26
27
28
29
30
31
32
33
34

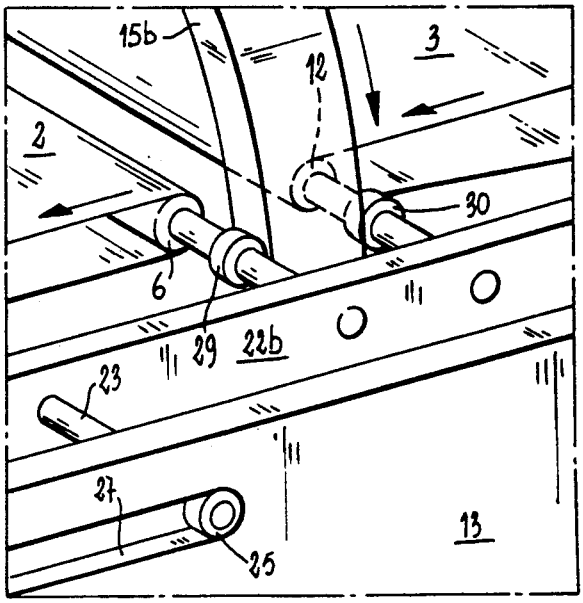
Fig. 4
Fig. 5
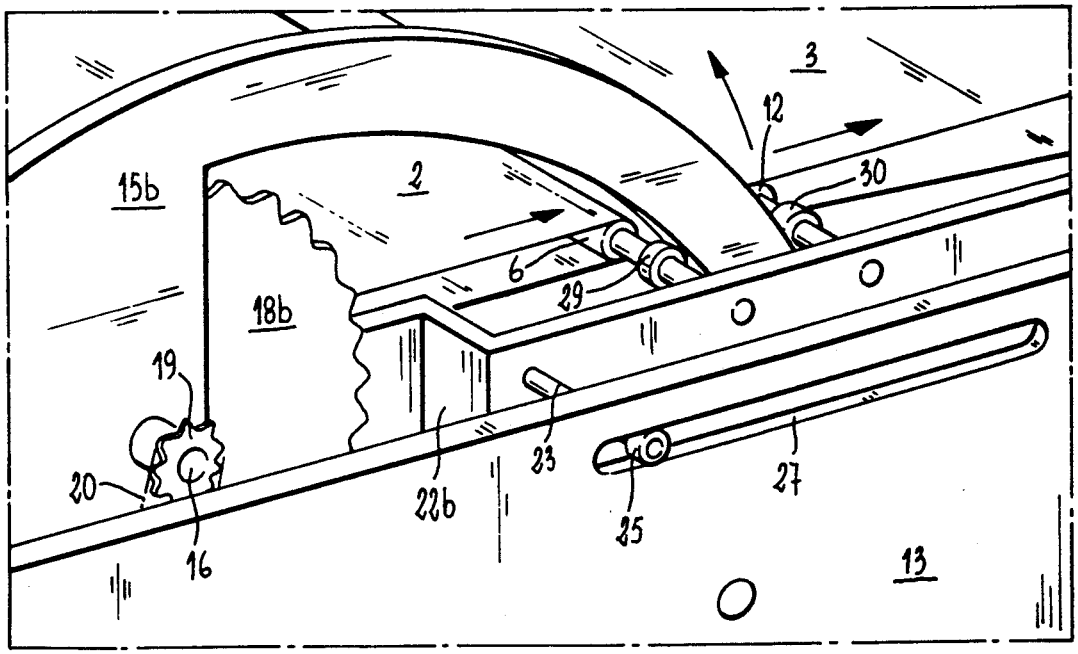

MACHINE FOR THE PACKAGING OF ARTICLES OF ANY SIZE IN SHEETS OF, IN PARTICULAR, A HEAT-SHRINKING MATERIAL

FIELD OF THE INVENTION

This invention relates to an improved machine for packaging articles of any size in sheets of, in particular, a heat-shrinking material.

BACKGROUND OF THE INVENTION

More specifically, this invention relates in particular to that type of known machine which operates either intermittently or continuously to package articles in pieces of sheets of in particular a heat-shrinking material comprising essentially a wrapping conveyor having a feed end, a delivery end and an upper surface between the two ends to support and convey successive articles which need to be wrapped; means to feed the wrapping material to supply single pieces of wrapping material in succession to the wrapping conveyor wherein the anterior ends of these pieces are above the upper surface of the wrapping conveyor at the feed end; conveyor belt means to deliver and receive the articles placed adjacently in sequence respectively but at a distance from the corresponding feed and delivery ends respectively of the wrapping conveyor; endless conveyor means carrying at least one wrapping bar along a track which passes around the wrapping conveyor to wrap the pieces of sheet of heat-shrinking material about a corresponding article on the wrapping conveyor; and means capable of synchronising the said wrapping conveyor, the means for supply of the wrapping material, the means for delivering and receiving articles and the endless conveyor and wrapping means with a bar in a synchronised manner.

OBJECTS OF THE INVENTION

The primary object of this invention is to improve the known type of wrapping machine, which can operate either intermittently or continuously, to provide a machine for packaging articles of any size by means of packaging materials, in particular heat-shrinking sheets which can be supplied in single pieces of suitable size.

SUMMARY OF THE INVENTION

An improved machine for the packaging of articles of any size using pieces of sheet of in particular a heat-shrinking material comprises essentially a wrapping conveyor having one feed end, a delivery end and a upper surface between the two ends to support and convey successive articles requiring wrapping; means to supply the wrapping material to provide a succession of pieces of wrapping material to the wrapping conveyor, placing the front ends of the sheets above the upper surface of the wrapping conveyor at its feed end; conveyor belt means to deliver and receive the articles placed adjacently in sequence respectively but at a distance from the corresponding feed and delivery ends respectively of the wrapping conveyor; endless conveyor means carrying at least one wrapping bar along a track which passes round the wrapping conveyor to wrap the pieces of sheet of heat-shrinking material around a corresponding article on the wrapping conveyor; and activating means capable of activating the wrapping conveyor. The means for supply of the wrapping material, the means for delivering and receiving articles and the said endless wrapping conveyor means with a bar are actuated in a synchronous manner. This machine being according to the invention is characterised in that the wrapper conveyor having one feed end, one delivery end and an upper surface between the two ends to support and successively convey articles to be wrapped and the belt conveyor means for receiving articles placed adjacently in sequence but at a distance from the corresponding delivery end of the wrapping conveyor has, depending on the size of the articles being wrapped, an upper delivery surface of a structured type with ends which can be positioned adjacently but at a distance and adjusted in a completely movable way in two directions and in that the endless transporter means having at least one wrapping bar along the track which passes round the wrapping feed to wrap the pieces of sheet of heat-shrinking material around a corresponding article on the wrapping feed are supported by a supporting structure which is in turn rotatably supported and can be adjustably positioned about a horizontal axis for adjustment in relation to the dimensions of the articles delivered for wrapping.

BRIEF DESCRIPTION OF THE DRAWING

Further objects features and advantages of the improved machine for the wrapping of articles according to this invention will be more apparent from the following description of a preferred embodiment provided purely by way of example with reference to the appended drawings in which:

FIGS. 4 and 5 show a corresponding detail of FIGS. 2 and 3, in perspective view and on an enlarged scale, for the packaging of articles of respectively maximum and minimum dimensions in accordance with the invention.

SPECIFIC DESCRIPTION

The improved machine according to this invention is of the type comprising essentially, in sequence, three conveyors, 1, 2, 3, having corresponding conveyor surfaces moving about their corresponding shafts in a closed loop, i.e. for the central conveyor for wrapping, indicated by 4, 5, 6, 7 and 8; for feed conveyor 1 upstream of the latter, indicated by 2, with at least two, of which only the downstream one is indicated by 9; and for the receiving conveyor 3, downstream of the wrapping conveyor 2, indicated by 10, 11 and 12.

Figure 1:
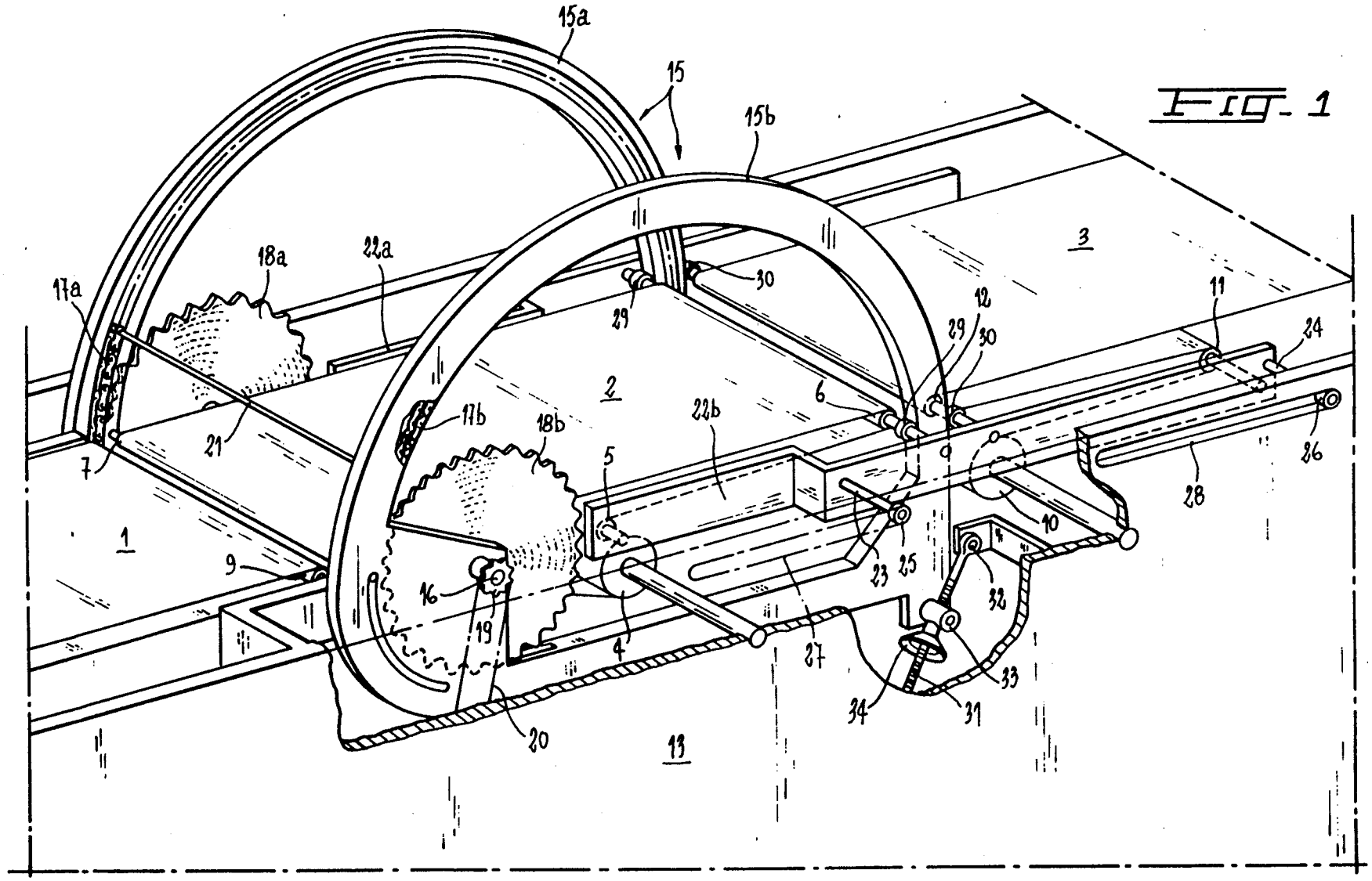
FIG. 1 is a foreshortened frontal-longitudinal perspective diagrammatic view of the machine according to the invention.

The feed conveyor 1, wrapping conveyor 2 and receiving conveyor 3 are placed in the horizontal plane and are aligned and spaced respectively by means of a supporting base which is shown diagrammatically and in part, but indicated as a whole by 13 (see in particular FIG. 1).

Figure 2:
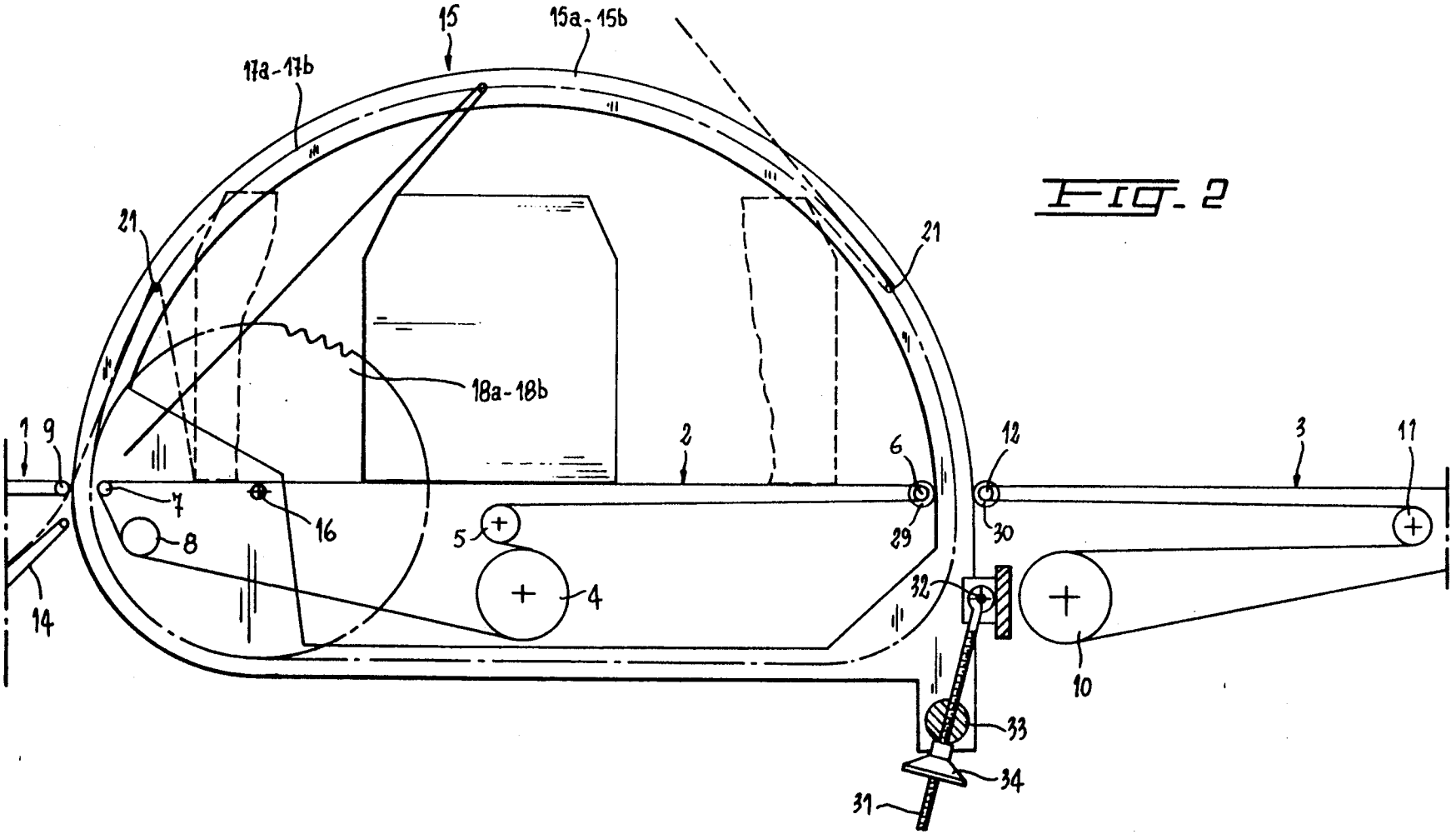
FIG. 2 is an frontal-longitudinal view according to FIG. 1, for the packaging of articles of a relatively large size in accordance with FIG. 3 is a frontal-longitudinal view of the machine according to the invention for packaging of articles of a relatively small size.

Supporting base 13 also bears coplanar conveyors of which only one is shown and is indicated by 14, see FIG. 2, in an inclined arrangement beneath the three conveyors 1, 2, 3 so that the most downstream conveyor, indicated by 14, ends close to the zone separatinq conveyors 1 and 2 in the series of three conveyors 1, 2, 3, and supporting structure 15 which is able to rotate about a horizontal shaft 16.

All conveyors are actuated by means 100. The supporting structure 15 comprises two side pieces 15*a* and 15*b* of an annular shape which are rotatably supported about horizontal shaft 16 in a mirror image arrangement on opposite sides of wrapping conveyor 2 (see FIG. 1).

Figure 3:
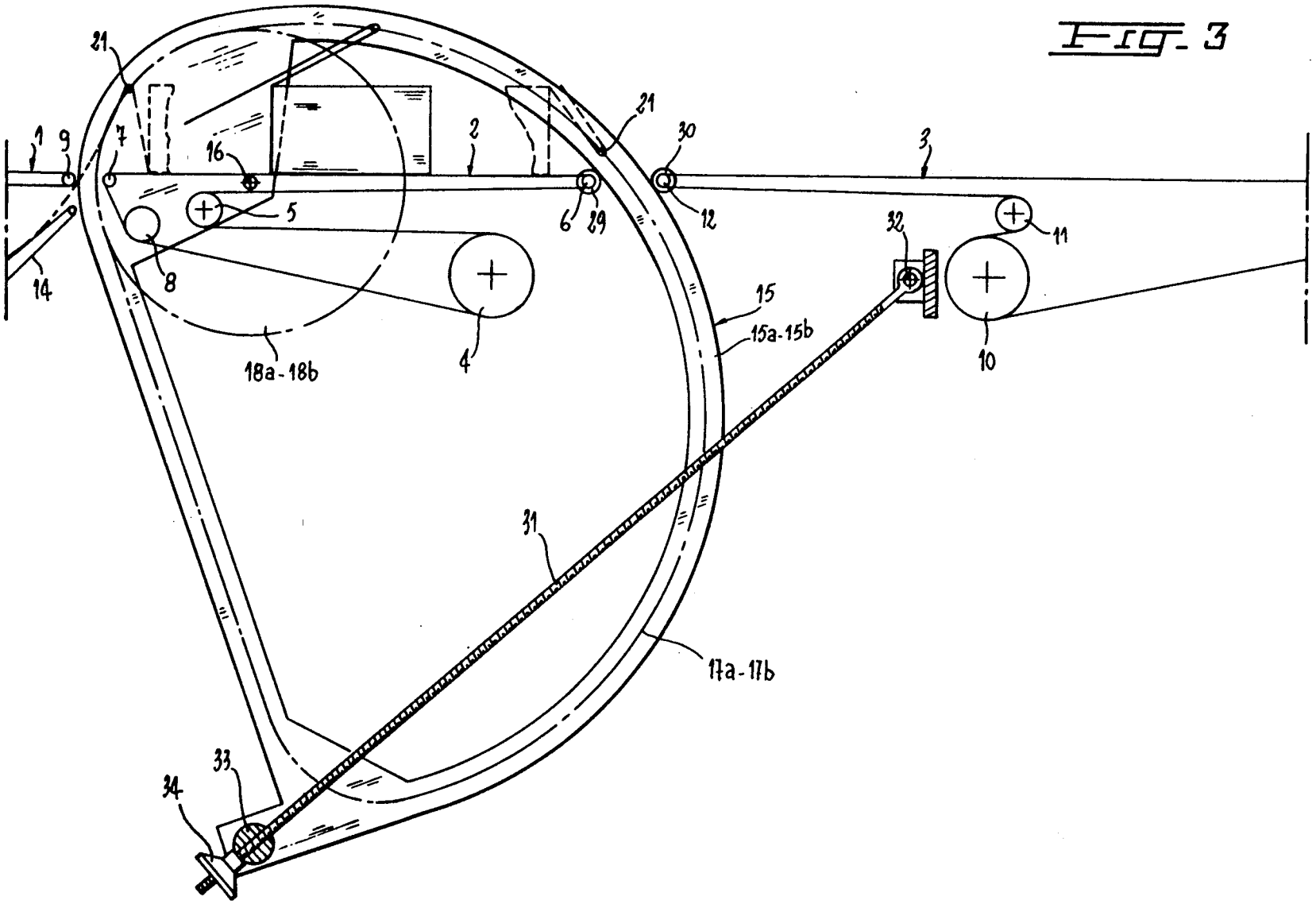

The inner mirror-image faces of the two annular sides 15*a* and 15*b* quidably support in a known way corresponding chains indicated by 17*a* and 17*b*, see again FIG. 1 and FIGS. 2 and 3, which also pass around corresponding chainwheels 18*a* and 18*b*, see in particular FIG. 1, keyed to horizontal shaft 16 on which a pinion 19 is also keyed and around which passes chain 20 (see again in particular FIG. 1) for driving chains 17*a* and 17*b* which end at the corresponding ends of equidistant horizontal rods, two in the case indicated, indicated by 21, thus forming the endless conveyor with a wrapping bar which moves around the track surrounding wrapping conveyor 2.

The opposing ends of shafts 5, 6 and 11, 12 around which wrapping conveyor 2 and receiving conveyor 3 respectively pass are supported by mirror-image truck members 22*a* and 22*b* which are in turn supported by base 13 of the machine by means of corresponding shafts 23 and 24 with corresponding rollers 25 and 26 in corresponding slots 27 and 28 in the base 13.

On the opposing ends of the shafts 6 and 12 around which the belts forming the wrapping conveyor 2 and receiving conveyor 3 respectively pass, there are mounted corresponding cam-following rollers 29 and 30 in contact with the annular internal and external surfaces respectively of side pieces 15*a* and 15*b* of supporting structure 15 which rotates about horizontal shaft 16.

A threaded rod 31 is also provided and hinged at one end rotatably about a horizontal pin 32 supported by base 13 of the machine, which threaded rod 31 extends and freely passes transversely through a cylinder 33 rotatably mounted about its own axis at the lower end opposite the end at which it is hinged to base 13 by means of horizontal shaft 16.

On this threaded rod 31 there is mounted an adjusting wheel 34, which can be screwed up and unscrewed to adjust the packaging machine in question for the packaging of a wide range of articles of different sizes.

Shafts 6 and 12 of the respective wrapping and receiving conveyors are provided with respective cam-following rollers 29 and 30 which are in sliding contact with respectively inner surface of the means 15 and with the outer surface thereof. Upon changing an effective wrapping path of the bar 21 the inner surface of means 15 guides cam-following rollers 29 along respective tracks 22*a* and 22*b*. At the same time rollers 30 which are in contact with the outer surface of means 15 are displaced along the tracks 22*a* and 22*b* changing thereby a length of upper stretch of receiving conveyor 3.

I claim:

1. A wrapping machine comprising:

a frame;

conveyor means on said frame including at least one endless transport conveyor for advancing a plurality of successive articles to be wrapped along a transport path, said conveyor being formed with an upper stretch having a length defined between upstream and downstream ends of said conveyor;

transport means on said frame for supplying a succession of sheets of wrapping material on said conveyor, each of said sheets having respective leading and trailing ends;

a pair of spaced apart support annular guides flanking said conveyor and mounted pivotally on said frame about a common axis, each of said supports being formed with a respective inner surface eccentric with respect to said axis;

a pair of endless belts each mounted on the respective inner surface of said supports;

a wrapping bar mounted on said pair of belts and movable therewith along a closed wrapping path having an arcuate downstream directed segment extending over said upper stretch for moving the bar downstream and bringing the trailing end of the respective sheet around the respective article while advancing the latter along said transport path;

adjusting means for pivoting said guides about said axis in order to vary a clearance between said upper stretch of said conveyor and said arcuate segment and for changing an effective length of said arcuate segment of said wrapping path according to a size of the respective article; and engaging means formed on said downstream end of said conveyor and being in contact with said inner surfaces of said guides for changing said length of said upper stretch upon varying said clearance.

2. The wrapping machine defined in claim 1 wherein said adjusting means include a rod having one end journaled on said frame, the other end of said rod being mounted on said guides and formed with screwing means for adjusting said clearance.

3. The wrapping machine defined in claim 1 wherein said engaging means include:

a carriage mounted on said frame;

upstream and downstream shafts mounted on said carriage and shiftable relative one another and supporting said transport conveyor, said downstream shaft being provided with a roller engaging said inner surfaces of said guides, said inner surfaces being cam surfaces.

4. The wrapping machine defined in claim 3 wherein said roller is a cam follower.

5. The wrapping machined defined in claim 3 wherein said engaging means further comprising a tension roller.

6. The wrapping machine defined in claim 1, further comprises a delivery endless conveyor for further transporting of wrapped articles mounted on respective upstream and downstream shafts, the upstream shaft of said delivery conveyor being spaced from the downstream end of said transport conveyor.

7. The wrapping machine defined in claim 6 wherein said upstream and downstream shafts of said delivery conveyor are shiftable relative to one another, a respective roller being mounted on the upstream shaft of said delivery conveyor and engaging an outer surface of said guides upon pivoting thereof.

* * * * *